US007347273B2

(12) United States Patent
George et al.

(10) Patent No.: US 7,347,273 B2
(45) Date of Patent: Mar. 25, 2008

(54) BOTTOM HOLD COMPLETION SYSTEM FOR AN INTERMITTENT PLUNGER

(75) Inventors: Grant George, Edmonton (CA); Geoff Steele, Edmonton (CA); Brent Kohls, Edmonton (CA)

(73) Assignee: Stellarton Technologies Inc., Calgary, Alberta (CA)

( * ) Notice: Subject to any disclaimer, the term of this patent is extended or adjusted under 35 U.S.C. 154(b) by 152 days.

(21) Appl. No.: 11/163,540

(22) Filed: Oct. 21, 2005

(65) Prior Publication Data

US 2007/0089885 A1 Apr. 26, 2007

(51) Int. Cl.
*E21B 23/06* (2006.01)
*E21B 33/129* (2006.01)

(52) U.S. Cl. ..... 166/382; 166/387; 166/240; 166/138

(58) Field of Classification Search ..... 166/118, 166/123, 138, 217, 240, 382, 387
See application file for complete search history.

(56) References Cited

U.S. PATENT DOCUMENTS 3,020,852 A 2/1962 Roach et al. ..... 103/225
3,678,998 A * 7/1972 Cockrell et al. ..... 166/123
4,664,188 A * 5/1987 Zunkel et al. ..... 166/134
4,949,793 A * 8/1990 Rubbo et al. ..... 166/382
4,991,654 A * 2/1991 Brandell et al. ..... 166/332.7
5,253,713 A 10/1993 Gregg et al. ..... 166/372
5,311,939 A * 5/1994 Pringle et al. ..... 166/134
5,427,504 A 6/1995 Dinning et al. ..... 417/59
5,803,191 A * 9/1998 Mackintosh ..... 175/170
6,155,346 A * 12/2000 Aldridge ..... 166/216
6,554,580 B1 4/2003 Mayfield et al.
6,644,399 B2 11/2003 Abbott et al. ..... 166/68
6,725,916 B2 4/2004 Gray et al. ..... 166/68.5
6,915,856 B2 7/2005 Gentry et al. ..... 166/382
7,080,693 B2 * 7/2006 Walker et al. ..... 166/387
2006/0272828 A1 * 12/2006 Manson ..... 166/387

* cited by examiner

*Primary Examiner*—Jennifer H. Gay
*Assistant Examiner*—Shane Bomar
(74) *Attorney, Agent, or Firm*—Bennett Jones LLP

(57) ABSTRACT

A bottom hole assembly for an intermittent lift plunger system includes a retrievable downhole anchor which may be set and reset in one downhole trip, a retrievable packing device, and a plunger stop.

5 Claims, 14 Drawing Sheets

BOTTOM HOLD COMPLETION SYSTEM FOR AN INTERMITTENT PLUNGER

FIELD OF THE INVENTION

The present invention relates to a bottom hole completion system for a plunger lift system for intermittently lifting well fluids in an oil and gas well to the surface.

BACKGROUND OF THE INVENTION

Conventional pump systems for delivery of a fluid from a well bore include pump jacks or positive cavity pumps. While these pump systems have achieved extensive use, they suffer from many disadvantages. One disadvantage is that these systems are expensive. This is particularly problematic for wells with low delivery rates as the cost of the equipment may be difficult to justify. Further, these systems require the use of external power or fuel, which requires the delivery of power or fuel to the well site. Again, the cost of providing power to a well having low delivery rate may be difficult to justify, particularly in remote well locations.

Differential gas pressure operated pistons, also known as plungers, have been used in producing subterranean wells where the natural well pressure is insufficient to produce a free flow of gas, and especially liquids, to the well surface. A completed well typically includes tubulars placed inside the well conduit, which extend from the reservoir of the well to the surface. The cylindrical plunger typically travels within the tubulars between the bottom hole assembly and the top of the tubulars, where a well valve and a lubricator are positioned. A spring is typically included inside the lubricator assembly to absorb the impact energy of the plunger when it reaches the surface. The well is shut in for a selected time period which allows downhole pressure to build up, then the well is opened for a selected period of time. When the well valve is opened, the plunger is able to move up the tubulars, pushing a liquid slug to the well surface. When the well valve is later closed, the plunger, aided by gravity, falls downwardly to the bottom of the tubulars. Typically, the open and closed times for the well valve are managed by a programmable electronic controller.

When the plunger is functioning properly, fluids accumulate and stay above the plunger and pressurized gases and/or fluids below the plunger are blocked from flowing up, around, and through the plunger. As a result, the plunger and accumulated fluids are pushed upwardly. The prior art devices use a variety of external, and sometimes internal, sealing elements which allow the plungers to block the upward flow of gases and to slidingly and sealably engage the tubulars, which accomplishes the lifting of fluids to the surface depending upon the variable well pressures. Improvements of this technology may permit economic operation of wells which were previously uneconomic.

The bottom hole assembly is run in a well using conventional wireline techniques and set immediately above perforations in the well casing, in order to isolate the hydrostatic head from the producing zone. However, a conventional bottom hole assembly with a velocity tube requires a landing nipple. If a landing nipple is located far above the perforations, the velocity tube becomes too lengthy and restrictive. Also, placement in the landing nipple becomes difficult with older wells that may have tubing suffering from corrosion or scale.

Therefore, there is a continuing need in the art for an improved bottom hole assembly for a plunger system, which obviates or mitigates disadvantages in the prior art.

SUMMARY OF THE INVENTION

The present invention comprises a bottom hole assembly for a plunger system for intermittently lifting fluids from a well. The bottom hole assembly comprises a downhole anchor and a packing element.

In one aspect, the invention comprises a retrievable bottom hole anchor comprising:

(a) a hollow cylindrical mandrel having a lower end and an upper end having a cone;

(b) a J-slot sub engaging the lower end of the mandrel, said sub defining a patterned slot having a running position, a pre-set position, a set position, and a retrieving position;

(c) a slip assembly comprising:

i. a lower housing having an upper end comprising a slip cage and a lower end comprising a bearing housing, concentrically disposed around the J-slot sub;

ii. means for frictionally engaging the tubing;

iii. at least one pin disposed between the lower housing and the J-slot sub, which pin engages the slot defined by the J-slot sub;

iv. at least two slip arms each having an upper end and lower end, wherein the lower end is retained by the slip cage and the upper end comprises a tubing engaging slip, said slip arms moveable between a retracted position and an extended position wherein each said slip disposed to slide over the cone when the slip assembly is actuated;

(e) wherein the mandrel and J-slot sub is moveable relative to the slip assembly between a running position where the pin is located in the running position in the slot and the slip arms are in the retracted position, a set position where the pin is located in the set position in the slot and the slips arms are in the extended position, a pre-set position intermediate the running position and the set position, and a retrieving position where the pin is located in the retrieving position in the slot and the slips arms are retracted;

(f) and wherein the anchor may move between the running, set and extended positions by lifting and dropping the J-slot sub relative to the pin.

Preferably, the slot pattern is continuous and repeated at least twice on the J-slot sub, and the slip assembly comprises at least two pins, wherein each pin engages a separate slot pattern.

In another aspect, the invention may comprise a downhole packing device for use in a bottom hole assembly comprising an anchor device as described herein, said packing device comprising:

(a) a tubular mandrel having exterior ratchet pawls and a plurality of collet fingers having an enlarged end;

(b) an upper housing comprising a top sub, a ratchet sub and a ratchet ring, said upper housing axially moveable relative to the mandrel, wherein said upper housing defines a plurality of openings for accepting shear screws affixed to the mandrel;

(c) a deformable resilient seal concentrically disposed around the mandrel, below the upper housing;

(d) a lower housing disposed below the seal comprising a release sub having an internal shoulder defining a collet trap which engage the collet finger ends;

(e) a collet locking tube concentrically disposed within the mandrel, and moveable between a first locking position which traps the collet fingers in the collet trap, and a second release position, said collet locking tube having interior ratchet teeth;

(f) wherein the upper housing is moveable between a first extended position where the upper housing does not bear on the seal and the shear screws are intact, and a second seal position, where the upper housing bears on the seal, deforming the seal radially outwards, and the shear screws are not intact;

(g) and wherein the mandrel pawls and the ratchet sub and ratchet ring cooperate to maintain the upper housing in the seal position as long as the collet fingers are trapped in the collet trap.

Preferably, the packing device is adapted to engage a retrieving pulling post and collet, wherein the retrieving collet fits within the collet locking tube and includes pawls adapted to engage the collet locking tube teeth, such that the retrieving pulling post and collet may be used to pull the collet locking tube to its second release position.

In yet another aspect, the invention may comprise a method of setting a downhole anchor as claimed in claim 1, using a wireline toolstring, comprising the steps of:

(a) running the anchor downhole in a running position, to an initial depth;

(b) lifting the toolstring to index the anchor to a pre-set position;

(c) lowering the toolstring to index the anchor to a set position;

(d) testing the ability of the anchor to support the toolstring weight;

(e) repeating steps (a) to (c) in another location either uphole or downhole from the initial depth if the anchor fails to support the toolstring weight in the initial depth; and (f) wherein steps (a) to (e) are performed in a single trip downhole.

Preferably, the downhole anchor is combined with a packing device as described herein, and the method includes the additional step of setting the packing device by jarring the tool string to shear the shear pins is performed after step (e) during the same trip downhole as steps (a) to (e).

The method includes the further steps of:

(a) landing a plunger stop and collet latch onto the top of the anchor or the packing device;

(b) operating an intermittent lift plunger;

(c) pulling the plunger stop and collet latch; and (d) inserting a toolstring having a pulling pole and collet into the packing device mandrel, and pulling upwards to releasing the packing device and to index the anchor to the pull position, either in a single motion or two separate motions;

(e) retrieving the anchor and packing device to the surface.

BRIEF DESCRIPTION OF THE DRAWINGS

The invention will now be described by way of an exemplary embodiment with reference to the accompanying simplified, diagrammatic, not-to-scale drawings. In the drawings.

DETAILED DESCRIPTION OF THE INVENTION

The present invention provides for a bottom hole assembly for use with an intermittent plunger. When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

The bottom hole assembly and its components will be described with regard to its orientation in use, such that the longitudinal axis of the bottom hole assembly is substantially vertical. Therefore, the terms "lateral", "radial" or "horizontal" shall refer to a direction or plane substantially perpendicular to the longitudinal vertical axis of the components of the bottom hole assembly (10).

Figure 1:
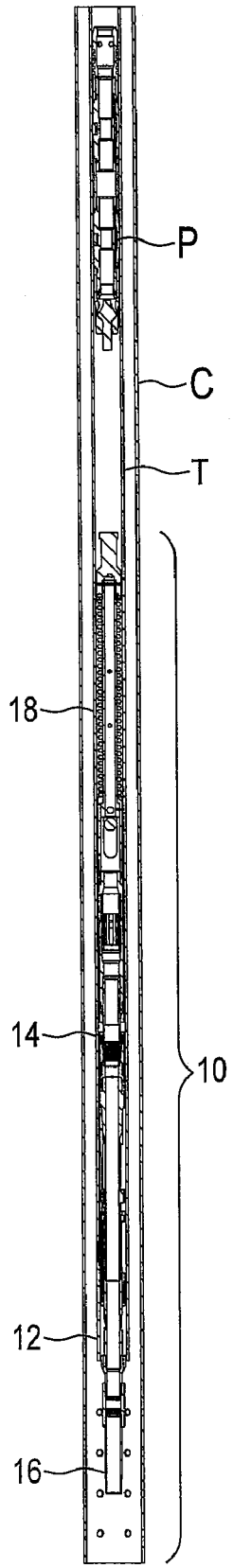
FIG. 1 is a schematic view of a subterranean bottom hole assembly for an intermittent plunger.

As shown in FIG. 1, one embodiment of the bottom hole assembly (10) comprises a downhole anchor (12), optionally a packer (14), and a velocity tube (16), and a plunger stop (18). The downhole anchor (12) functions to fix the position of the plunger stop (18) used to activate a plunger (P) of the general type of plungers operated by differential gas pressure, as is well known in the art. An exemplary plunger is described in Applicant's co-owned U.S. patent application Ser. No. 11/162,805, filed on Sep. 23, 2005, the contents of which are incorporated herein by reference. The plunger stop (18) is preferably positioned immediately above a formation perforation.

The following description describes the installation of the components of the bottom hole assembly (10) into a production tubing string. One skilled in the art will realize that the same components may be adapted to be installed in any string or continuous length of tubulars, which may be tubing (T), casing (C) or otherwise.

The packer (14) includes a radial sealing element which functions to seal the annulus between the tool string and the tubing wall, thereby ensuring that well fluids are produced through the velocity tube (16). The plunger stop (18) includes a landing pin (19) and a spring (20), which serves to absorb the force when the plunger (P) lands on the plunger stop (18). The landing pin (19) causes a plunger valve to close, in the particular example illustrated. Once the valve closes, fluid pressure will begin to rise within the plunger internal chamber, causing plunger seals to expand outward.

Once the seals expand to contact the well bore surface, fluids will not be able to rise above the plunger (P) and the rate of change of the pressure differential will accelerate. Eventually, the pressure underneath the plunger (P) will overcome any frictional resistance of the seals against the tubing surface and the hydrostatic force of the fluid column above the plunger (P), and cause the plunger (P) to rise. Any fluids above the plunger (P) will thus be lifted to the surface.

One embodiment of a downhole anchor (12) is shown in the Figures. A tubular mandrel (100) has an upper end (102) adapted as a fishneck and a lower end attached to a J-slot sub (104). A lower housing (106) encircles the J-slot sub (104) and has a slip cage (108) at an upper end and attaches to a bearing housing (110) at a lower end. The lower housing (106) is fitted with a plurality of belly springs (112) which are intended to create drag along the tubing (T) as the downhole anchor (12) is moved downhole. When fully relaxed, the springs (112) create a diameter greater than inside diameter of the tubing (T). Thus, when compressed and inserted into the tubing (T), the belly springs (112) bear against the tubing (T), creating frictional drag as the downhole anchor (12) is moved within the tubing (T).

The upper portion of the tubular mandrel (100) is flared to create a cone (114). A slip assembly includes plurality of slip arms (116) hingedly attached at one end to the slip cage (108), and have a tubing engaging surface, commonly referred to as a "slip" (118), at the upper end of each slip arm (116). Slips (118) are generally considered to be the portion of a slip arm (116) having gripping teeth on the outside and an angle to match the cone (114) on the inside. The slip arms (116) are retained by a slip arm retaining ring (120) around the circumference of the tubular mandrel (100), which limits the outward movement of the slip arms (116), but permits sufficient outward movement to allow the slips (118) to contact the inside surface of the tubing (T). As the lower housing (106) slidingly engages the J-slot sub (104) and a lower portion of the mandrel (100), the slip assembly and the mandrel (100) may move axially relative to each other. As the slip arms (116) slide upwards relative to the mandrel (100), the cone (114) forces the slips (118) outwards and into contact with the tubing wall. O-ring seals (119) are provided at the fishneck and between the mandrel (100) and the J-slot sub (104), and may also be included at the bottom of the tool to ensure pressure competence throughout the tool string.

Figure 2:
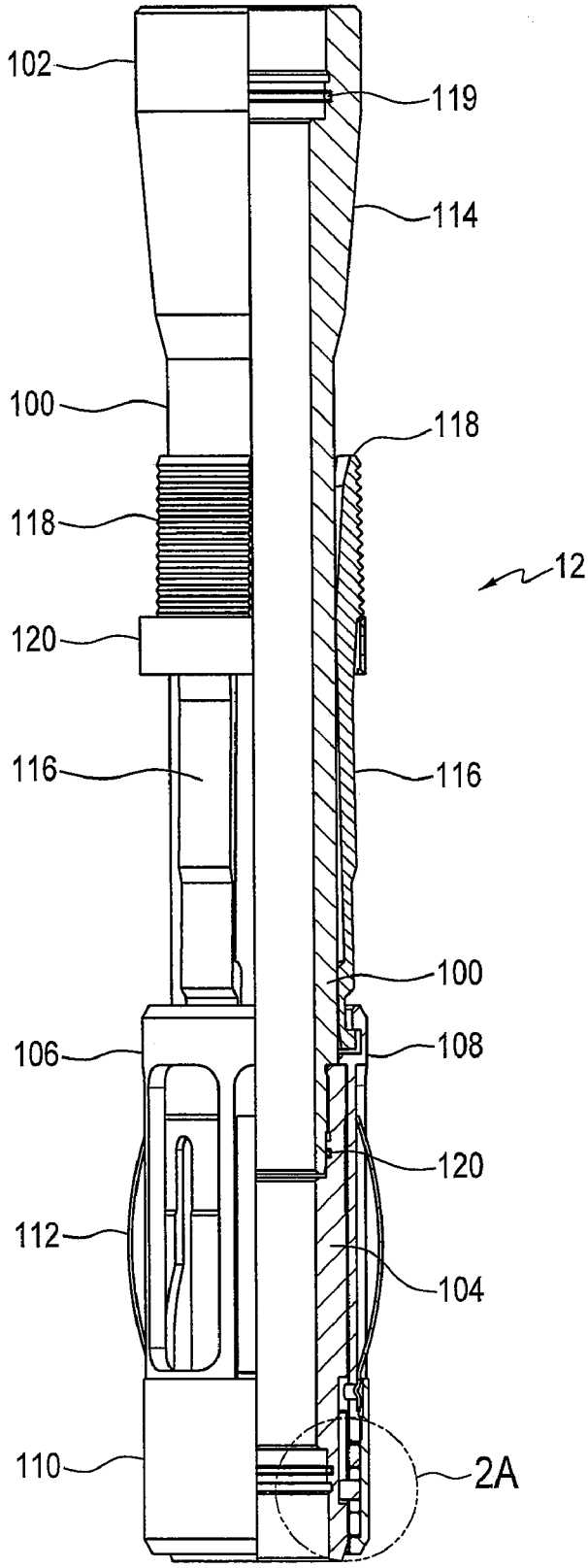
FIG. 2 is a cross-sectional view of one embodiment of a downhole anchor.
Figure 2A:
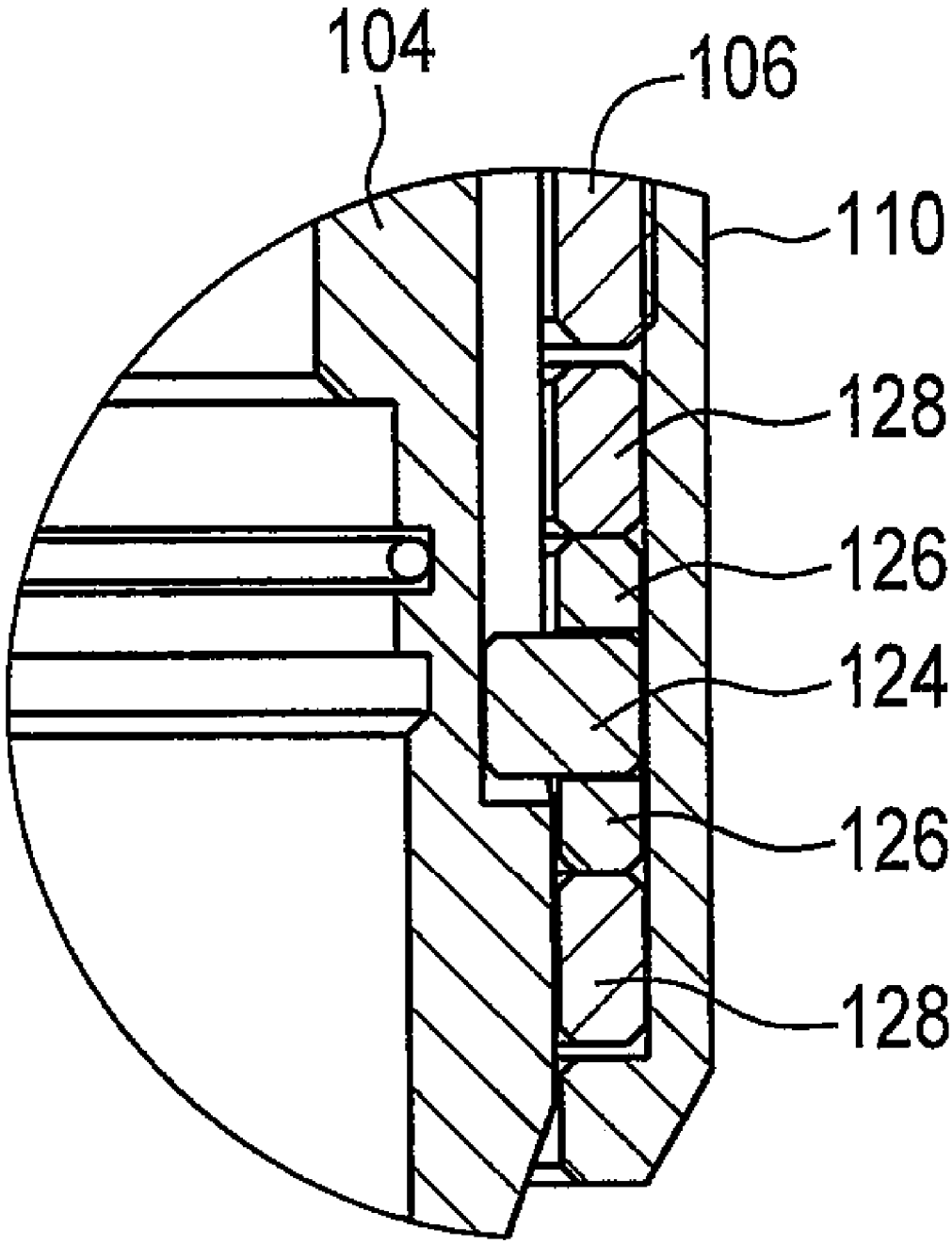
FIG. 2A is an detailed view of the bearing assembly shown in FIG. 2.
Figure 3:
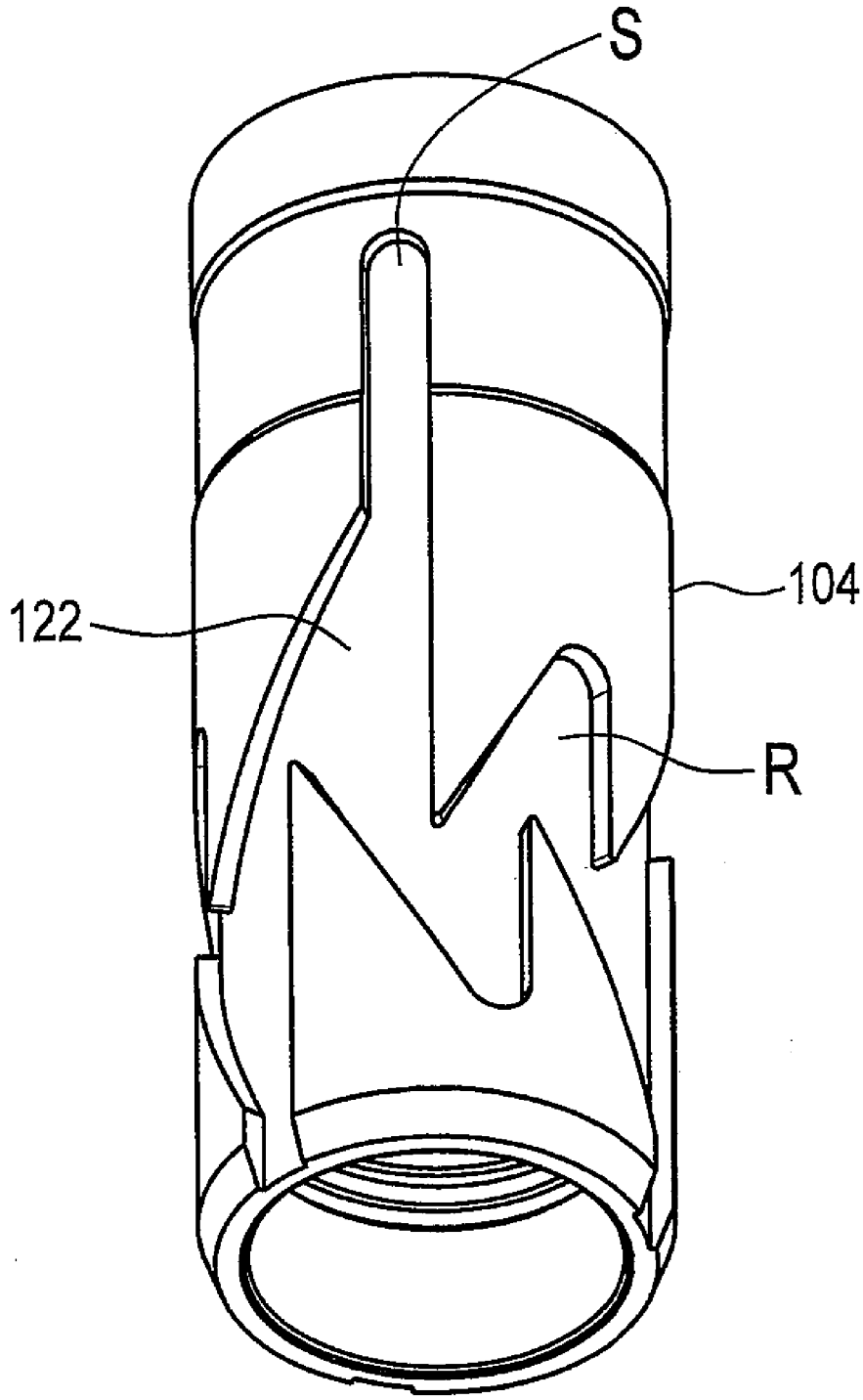
FIG. 3 is a pictorial view of a J-slot sub of a downhole anchor of the present invention.

As shown in FIG. 3, the J-slot sub (104) defines an exterior slot (122), which guides the movement of a pin (124) disposed between the bearing housing (110) and the J-slot sub (104). The pin (124) is fixed vertically as part of the slip assembly, as shown in FIG. 2A. The pin (124) is vertically bounded by bearing rings (126) and by friction reducing bearings (128), which may preferably be bronze bearings.

Figure 4:
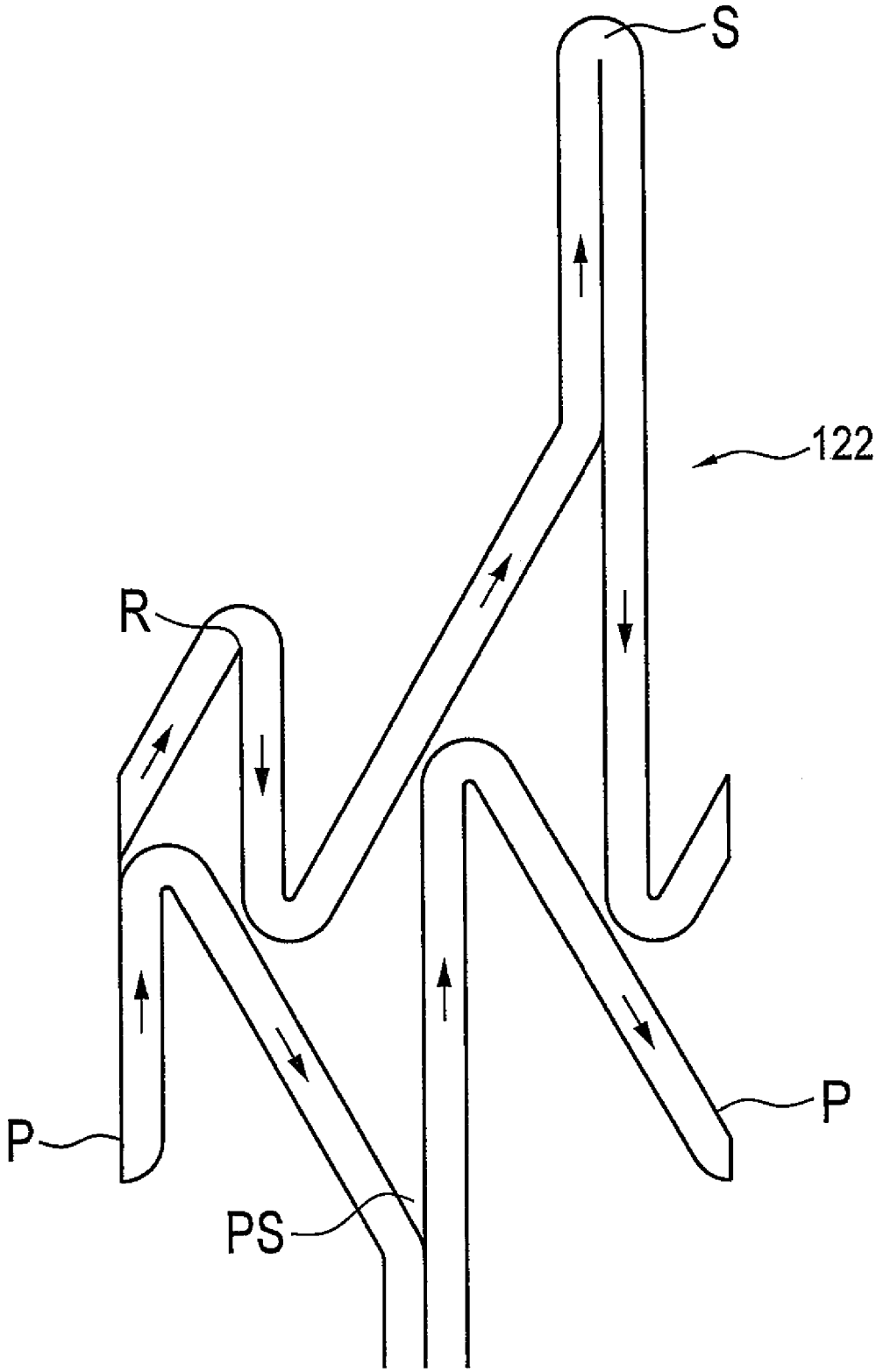
FIG. 4 is schematic of the slot pattern of a J-slot sub.

Accordingly, vertical movement of the J-slot sub (104) relative to the pin (124) (and thus the lower housing (106)) actuates movement of the slip assembly. The slot (122) is patterned to create at least three positions for operation of the downhole anchor (12). The slot pattern is shown in FIG. 4 in a flat two-dimensional manner. As one skilled in the art will appreciate, the slot pattern is continuous around the cylindrical exterior surface of the J-slot sub (104) and may be repeated. In one embodiment, the slot pattern is repeated two or three times around the circumference of the J-slot sub (104), necessitating the use of two or three pins (124) respectively.

Figure 5:
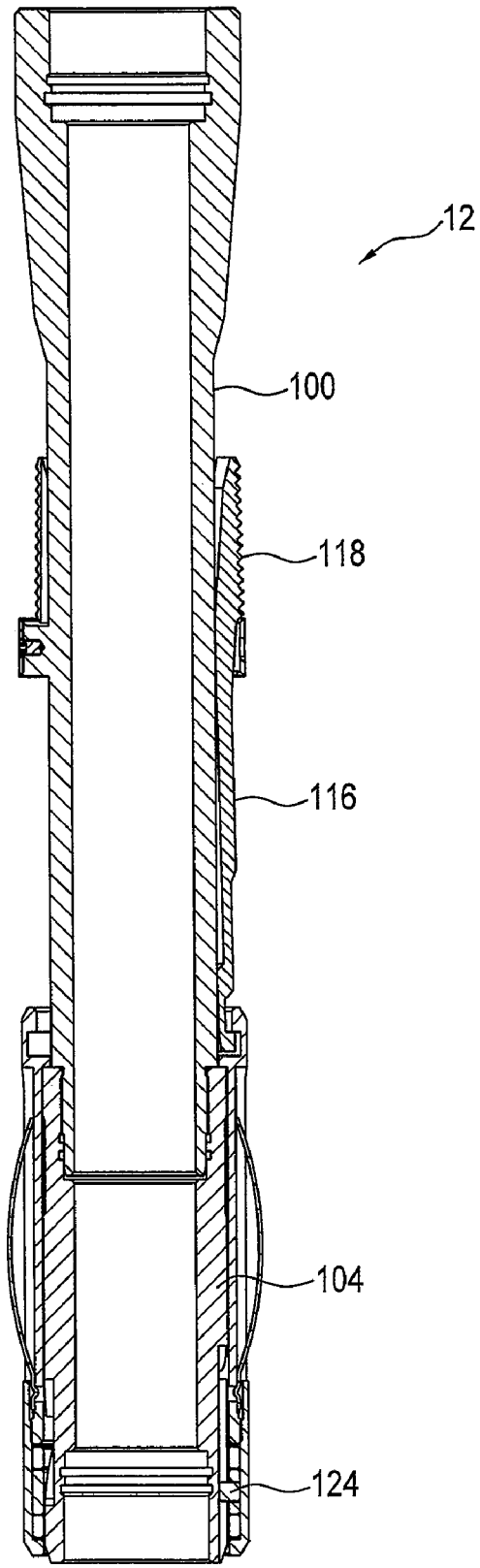
FIG. 5 is a cross-sectional view of the downhole anchor shown in FIG. 2 in the pulling position.

In a first running position (R), where the mandrel (100)/J-slot sub (104) is raised relative to the pin (124), the slip arms (116) are retracted. In a set position (S), where the mandrel (100)/J-slot sub (104) is lowered relative to the pin (124), the slip arms (116) are extended radially outward by the cone (114). In a preferred embodiment, a position intermediate the running (R) and set positions (S) is provided as a pre-set position (PS). In a pull position (P), where the mandrel (100)/J-slot sub (104) is again raised relative to the pin (124), the slip arms (116) are fully retracted, and the downhole anchor (12) may be pulled within the tubing (T) by fishing the mandrel (100). The downhole anchor (12) indexed to the pull position (P) is shown in FIG. 5.

Figure 6:
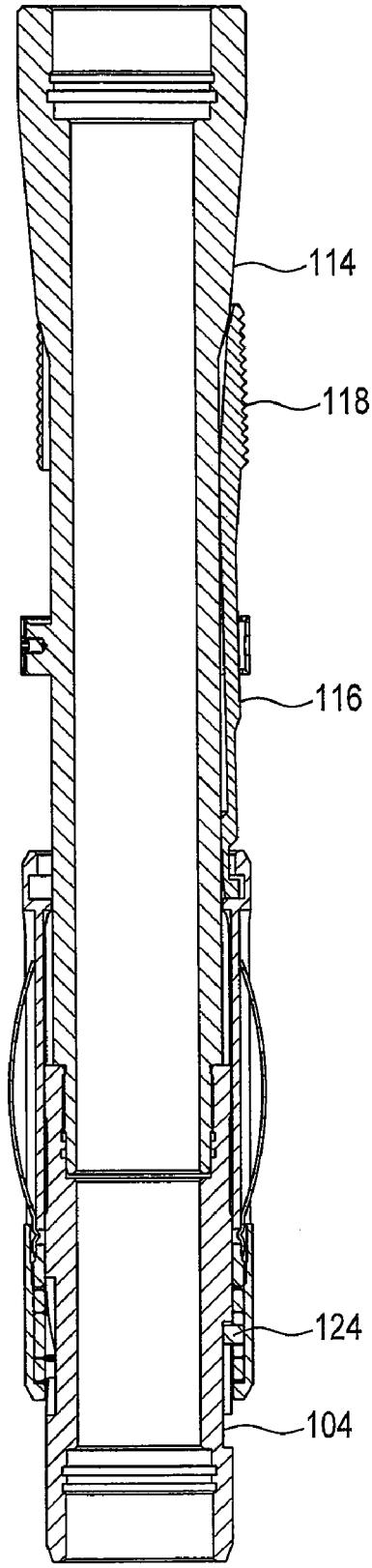
FIG. 6 is a cross-sectional view of the downhole anchor shown in FIG. 2 in the running position.

In operation, the downhole anchor (12) may be lowered into the tubing string using conventional wireline techniques. The upper end (102) of the tubular mandrel (100) may be adapted to accept a standard wireline running and pulling tool and/or may also be adapted to accept the packer (14), as described below. When the downhole anchor (12) is run into the well, it is indexed to the running position (R), where the pin (124) bears upwards against the J-slot sub (104), as a consequence of the drag created by the belly springs (112) as the downhole anchor (12) is moved downhole. As shown in FIG. 6, the slips (118) are partially retracted in the running position (R), but do not interfere with the tubing (T).

Figure 7:
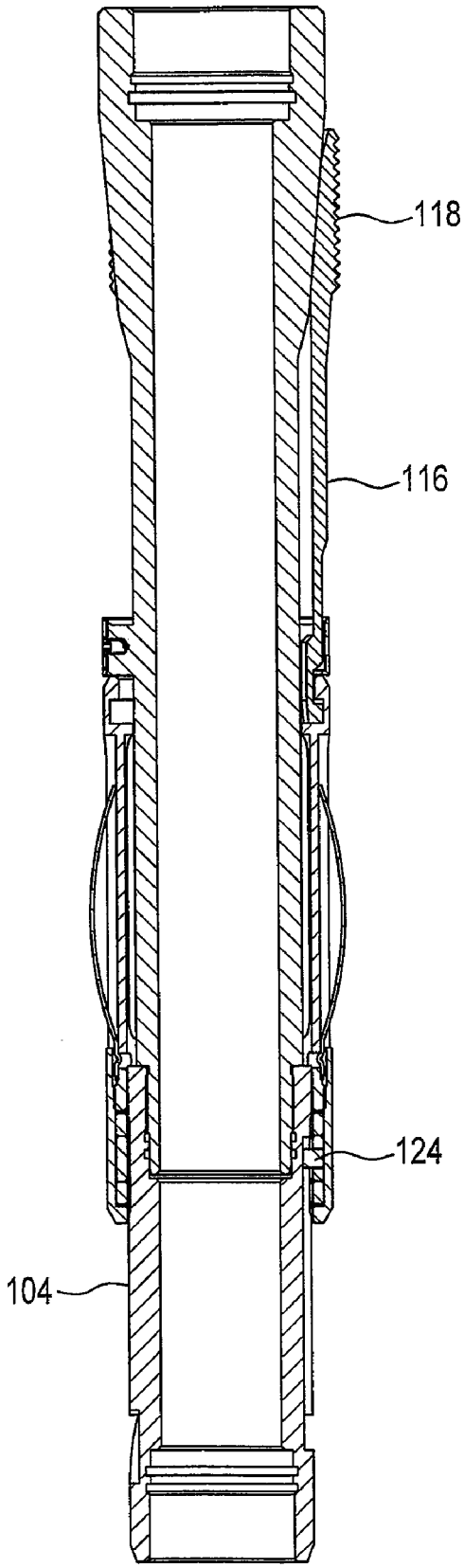
FIG. 7 is a cross-sectional view of the downhole anchor shown in FIG. 2 in the maximum set position.

Once in position, the tool string, which may include hydraulic jars, spang or mechanical jars and a weight bar, is raised to take up slack in the tool string and index the downhole anchor (12) to the pre-set position (PS). As may be seen, simply pulling up on the tool string will cause the pin (124) to move within the slot from the running position (R) to the pre-set position (PS). Lowering the tool string from the pre-set position (PS) will cause the pin (124) to move to the set position (S), which actuates the slips (118) to engage the tubing interior surface. FIG. 7 shows the slips (118) at a maximum set position. The slips (118) may engage the tubing (T) before the slips (118) reach the maximum set position. At this point, the downhole anchor (12) should accept and hold the weight of the tool string. If not, this may indicate that the downhole anchor (12) is placed in an unsuitable place in the tubing (T), where the tubing (T) is damaged or corroded. The downhole anchor (12) may then be moved uphole or downhole to find a suitable anchor position.

In order to move up the hole, the tool string may be raised to index the downhole anchor (12) to the pull position (P) and moved up the hole. Once in position, the tool string may be lowered to index the downhole anchor (12) to the running position (R), from where the set procedure above may be repeated.

In order to move down the hole, after the tool string is lowered to index the downhole anchor (12) to the running position, the tool string may lowered to a desired depth and the set procedure may be repeated.

The slot pattern (122) allows automatic indexing of the downhole anchor (12) between the various positions by simply raising and lowering the tool string, without lateral movement. Lateral movement within the slot pattern (122) is governed by the slot itself. The slot pattern (122) is such that the downhole anchor (12) is indexed through its positions automatically and unidirectionally. In other words, the same series of positions results from continuously indexing of the downhole anchor (12). The path followed by the pin (124) within the groove is shown by the arrows in FIG. 4. As a result, the downhole anchor (12) may be set and reset repeatedly within the tubing (T), without pulling the toolstring and downhole anchor (12) out of the hole.

Figure 8:
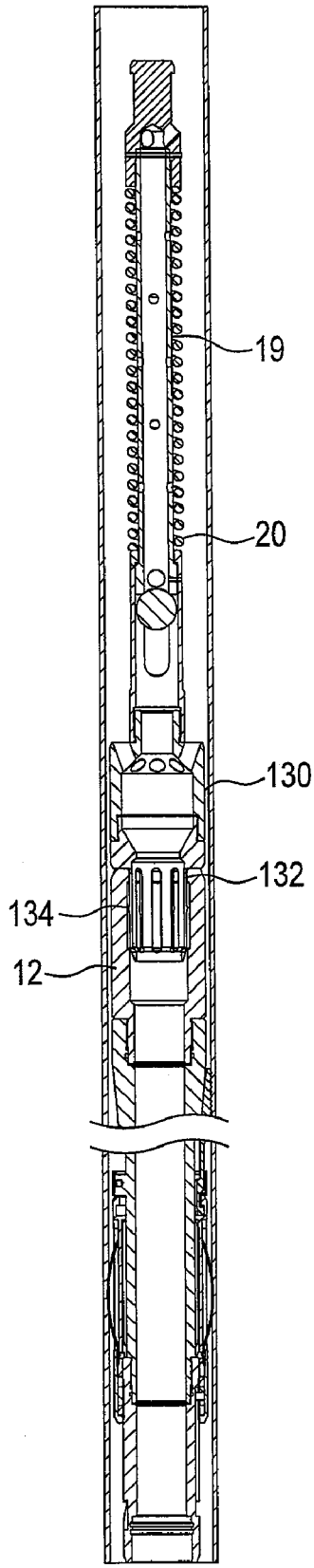
FIG. 8 is a cross-sectional view of a downhole anchor receiving a plunger stop and collet latch.
Figure 9A:
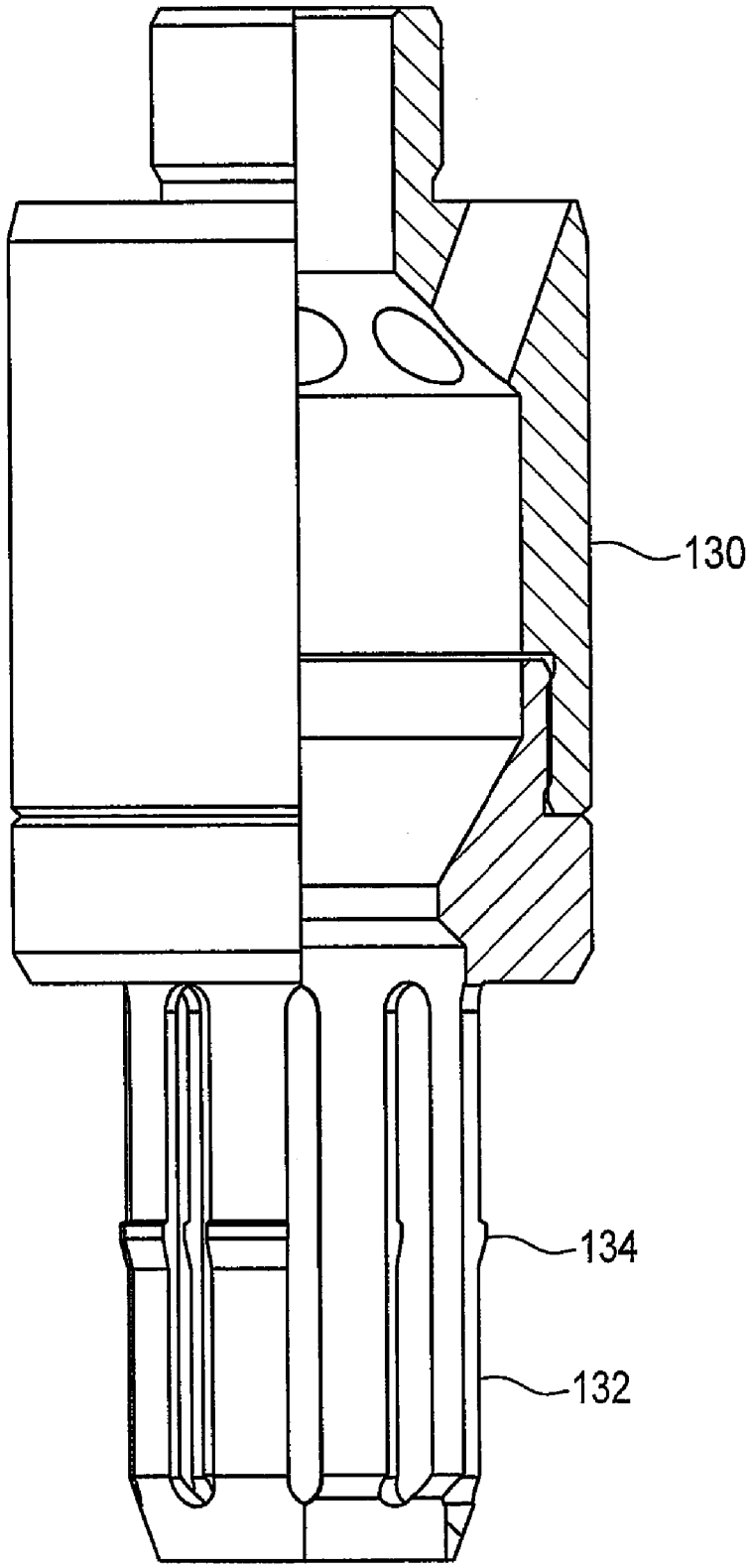
FIG. 9A is a partial cross-sectional view of a collet latch.
Figure 9B:
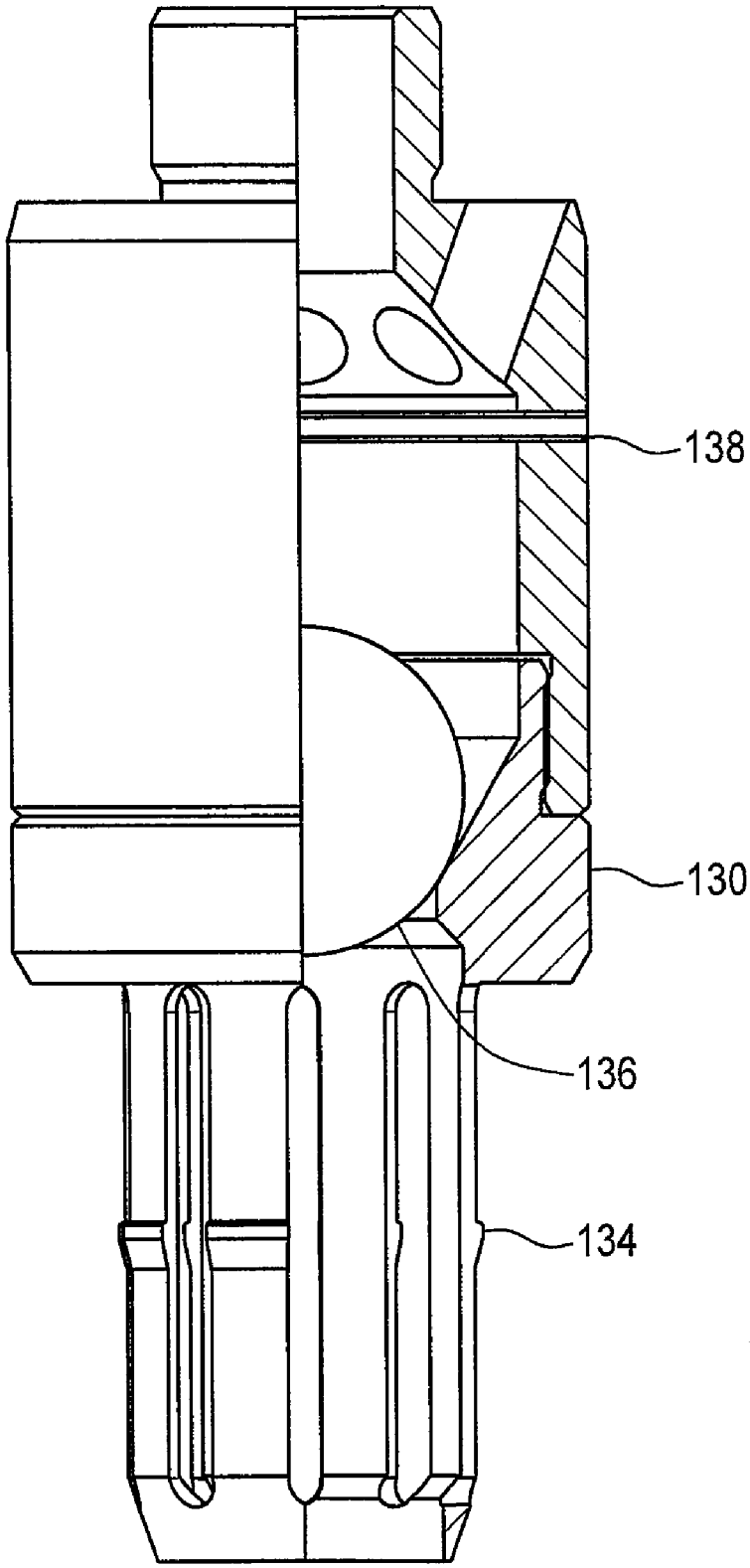
FIG. 9B is a partial cross-sectional view of an alternative embodiment of a collet latch.

The plunger stop (18) may then be landed onto the downhole anchor (12) with a collet latch (130) shown in FIG. 8. The collet latch (130) includes a cage (132) defining a lip (134) which engages the profile on the top of downhole anchor (12). The collet latch (130) is hollow and has a plurality of oblique openings to allow fluids to pass through relatively unimpeded. The collet latch (130) may optionally include a one-way ball valve (136), to prevent reverse flow through the collet latch (130), as is shown in FIG. 9B. A bar or pin (138) retains the ball (136).

Figure 10:
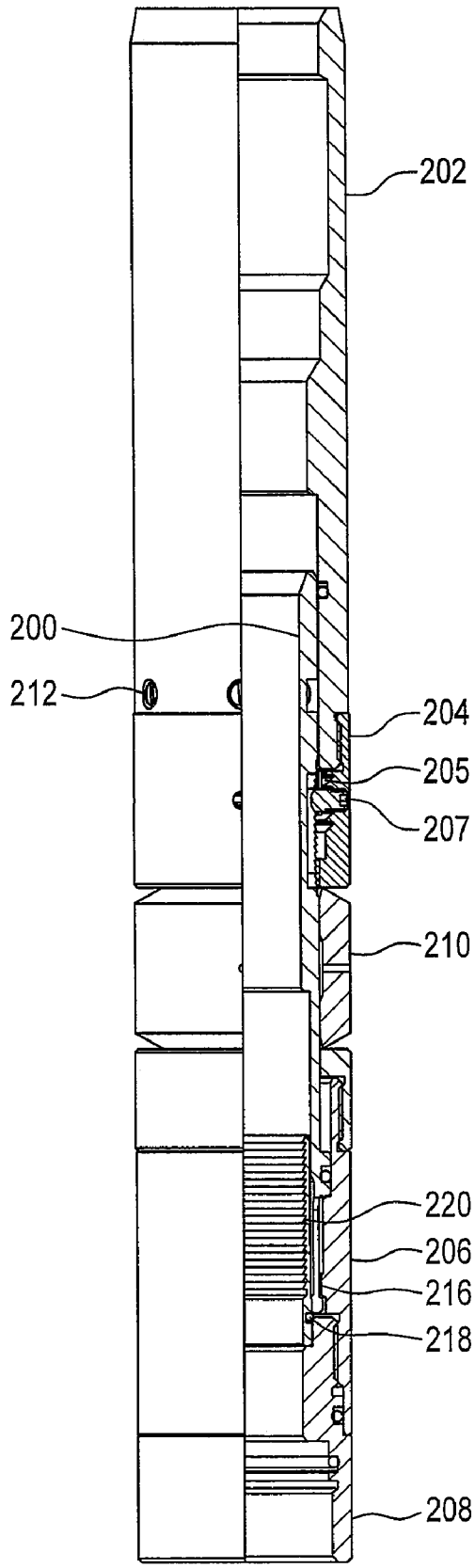
FIG. 10 is a partial cross-sectional view of a packing element of the present invention.

In some applications, it may be necessary to provide a seal inside the tubing string using a packer (14), one embodiment of which is shown in FIG. 10. The packer (14) and the downhole anchor (12) may be threaded together and inserted as a single unit by wireline. The packer (14) comprises a tubular mandrel (200) which slidingly engages an outer housing which, in one embodiment, is made up of a top sub (202), an outer ratchet sub (204), a release sub (206), and a bottom sub (208). Downward movement of the top sub (202), outer ratchet sub (204), and the ratchet ring (205) relative to the tubular mandrel (200) will squeeze the seal (210) radially outwards, creating a seal with the inside diameter of the tubing (T). A set screw (207) passes through a "split" in the ratchet ring (205) and engages a slot in the mandrel (200) in order to rotationally lock the outer housing relative to the tubular mandrel (200).

In a running position (R), the packer (14) is an elongated position with the seal (210) relaxed. The packer (14) is kept in this position by a plurality of shear screws (212) which pass through the top sub (202) and extend into the mandrel (200). Until sufficient force is brought to bear on the top sub (202) to break the shear screws (212), the packer (14) is held in the running position (R). The bottom sub (208) is adapted to fit and engage the top of the downhole anchor (12). The packer (14) is set by jarring down with the tool string after the downhole anchor (12) has been set. The downward impacts of the jarring motion shears the shear screws (212) and allows the top sub (202), outer ratchet sub (204) and ratchet ring (205) to move downwards along the mandrel (200). The pawls (214) on the mandrel (200) allow the ratchet sub (204) to ratchet downwards to compress the seal (210). Collet fingers (216) on the mandrel (200) are set in the collet trap (218) on the release sub (206), which locks the packer (14) in its set position (S). A collet locking tube (220) having internal ratchet teeth is positioned within the collet fingers (216) and affixed to the bottom sub (208). The collet locking tube (220) maintains the collet fingers (216) in the collet trap (218) of the release sub (206). Once the ratchet sub (204) has ratcheted downwards on the mandrel (200), the seal (210) exerts an upward force on the mandrel (200) and thus the collet fingers (216), which are locked in the collet trap (218) by the collet locking tube (220).

Once the downhole anchor (12) and then the packer (14) are set, a plunger stop (18) as may then be landed onto the packer (14) with a collet latch (130), as shown schematically in FIG. 1 and in more detail in FIG. 8. The collet latch (130) includes a cage (132) defining a lip (134) which engages and latches (130) onto the profile on top of packer (14). The collet latch (130) preferably includes a ball check.

Figure 11:
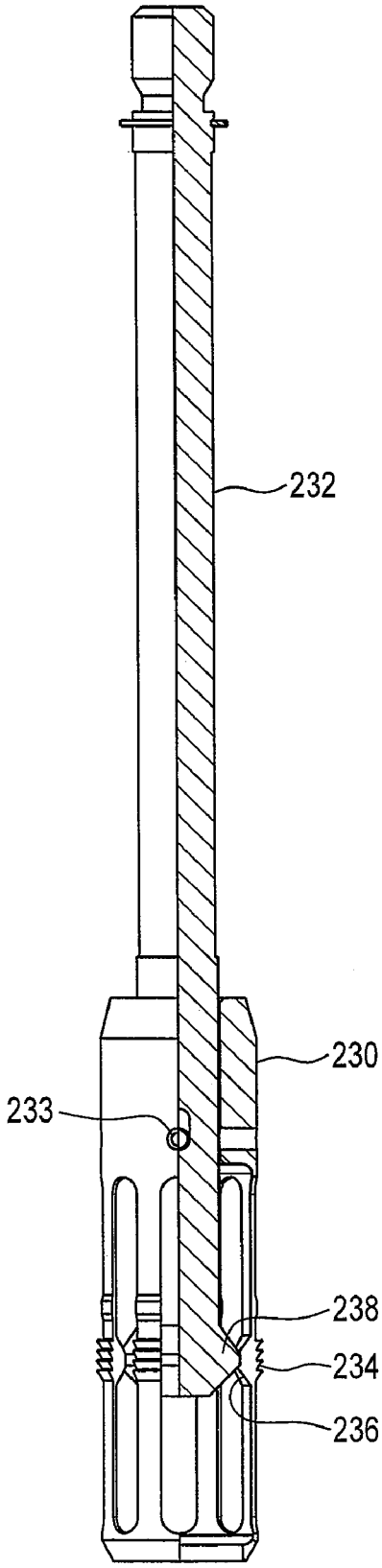
FIG. 11 is a partial cross-sectional view of a pulling pole and retrieving collet.
Figure 12:
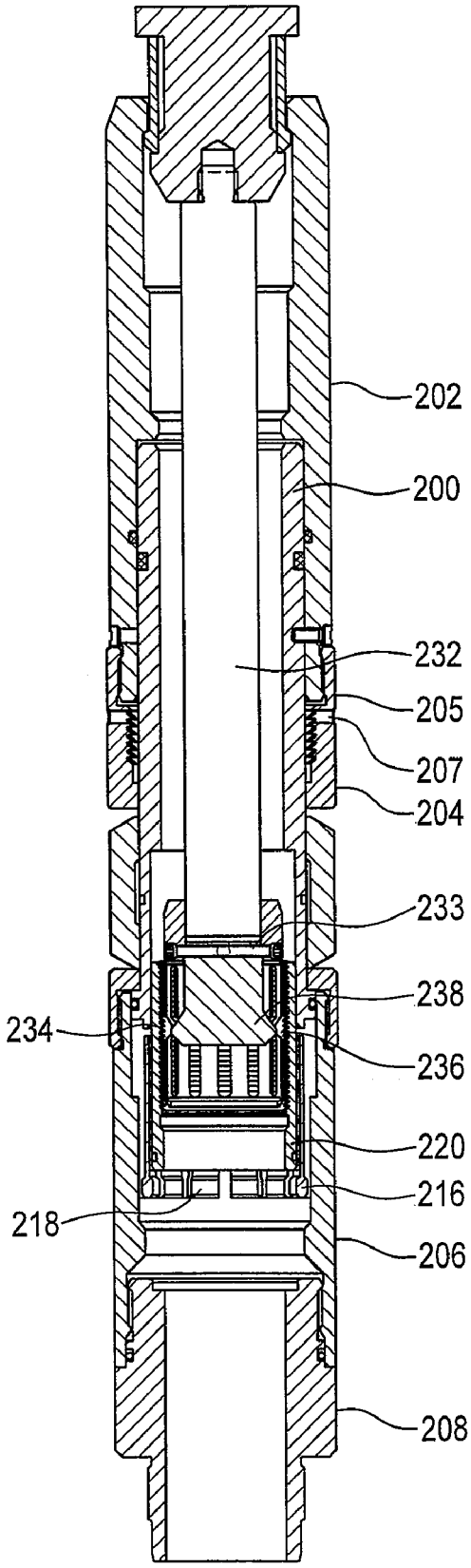
FIG. 12 is a cross-sectional view of a packing element and a pulling pole and retrieving collet in combination.

To release the packer (14), the plunger stop (18) and collet latch (130) are simply pulled out of the packer (14). The packer (14) and downhole anchor (12) are in set positions (5) and easily provide sufficient resistance to the pulling action. Once the plunger stop (18) and collet latch (130) are removed, a retrieving collet (230) fitted to a pulling post (232) is stabbed into the packer mandrel (200) until it lands inside the collet locking tube (220). The collet (230) has a cage (231) with exterior pawls (234) which engage the ratchet teeth on the collet locking tube (220). On the inside of the cage (132), opposite the pawls (234), each cage member includes a collet lug such that a cage ridge (236) is formed. The inside diameter of the cage ridge (236) defined by the collet lugs is less than the cage (132) itself. The pulling post (232) extends into the collet cage (132) and ends with an upset (238), which is an enlarged section on the end of the pulling post (232), and which has an outside diameter approximately equal to the inside diameter of the cage ridge (236). The pulling post (232) is moveable axially within the cage (132) between a position where the pulling post upset (238) is aligned with the ridge (236), as shown in FIG. 11, and a lowered position where the upset (238) is disposed just below the ridge (236). As is apparent, when the upset (238) and the ridge (236) are aligned, the cage (231) cannot deform inwardly.

Axial movement of the pulling post (232) is limited by a shear pin (233) fitted through an opening in the pulling post (232) and fixed to the collet (230). The shear pin (233) permits disengagement of the pulling post (232) by application of sufficient force to break the shear pin (233), which may be necessary in cases where the collet locking tube (220) cannot be released. Shearing the pin (233) moves the pulling postupset (238) from below the ridge (236) allows the fingers (216) to relax (flex inward) and pull free from the collet locking tube (220).

When the collet is stabbed into the packer (14), the protrusion and ridge are not aligned, the collet cage (231) may flex inwards, permitting the pawls (234) to ratchet past the teeth on the collet locking tube (220). When the pulling post (232) is pulled upwards, the protrusion and ridge align, preventing the pawls (214) and the teeth from disengaging, which then causes the collet locking tube (220) to slide upwards within the packer (14). Upwards movement of the collet locking tube (220) releases the collet fingers (216) of the packer mandrel (200) from the collet trap (218) of the release sub (206). The mandrel (200), top sub (202) and ratchet sub (204) thus move upwards relative to the release sub (206), thereby extending the packer (14) to an unset position, with the seal (210) retracted.

As will be apparent to those skilled in the art, various modifications, adaptations and variations of the foregoing specific disclosure can be made without departing from the scope of the invention claimed herein. The various features and elements of the described invention may be combined in a manner different from the combinations described or claimed herein, without departing from the scope of the invention.

What is claimed is:

1. A downhole packing device for use in a bottom hole assembly comprising an anchor device comprising a hollow cylindrical mandrel having a lower end and an upper end having a cone; a J-slot sub engaging the lower end of the mandrel, said sub defining a patterned slot having a running position, a pre-set position, a set position, and a retrieving position; a slip assembly comprising i. a lower housing having an upper end comprising a slip cage and a lower end comprising a bearing, concentrically disposed around the J-slot sub; ii. means for frictionally engaging the production tubina; iii. at least one pin disposed between the lower housing and the J-slot sub, which pin engages the slot defined by the J-slot sub; and iv. at least two slip arms each having an upper end and lower end, wherein the lower end is retained by the slip cage and the upper end comprises a tubing engaging slip, said slip arms moveable between a retracted position and an extended position wherein each said slip is disposed to slide over the cone when the slip assembly is actuated; wherein the mandrel and J-slot sub are moveable relative to the slip assembly between a running position where the pin is located in the running position in the slot and the slip arms are in the retracted position, a set position where the pin is located in the set position in the slot and the slips arms are in the extended position, a pre-set position intermediate the running position and the set position, and a retrieving position where the pin is located in the retrieving position in the slot and the slips arms are retracted; and wherein the anchor may move between the running, set and extended positions by lifting and dropping the J-slot sub relative to the pin; said packing device comprising:

(a) a tubular mandrel having exterior ratchet pawls and a plurality of collet fingers having an enlarged end;

(b) an upper housing comprising a top sub, a ratchet sub and a ratchet ring, said upper housing axially moveable relative to the mandrel, wherein said upper housing defines a plurality of openings for accepting shear screws affixed to the mandrel;

(c) a deformable resilient seal concentrically disposed around the mandrel, below the upper housing;

(d) a lower housing disposed below the seal comprising a release sub having an internal shoulder defining a collet trap which engages the collet finger ends;

(e) a collet locking tube concentrically disposed within the mandrel, and moveable between a first locking position which traps the collet fingers in the collet trap, and a second release position, said collet locking tube having interior ratchet teeth;

(f) wherein the upper housing is moveable between a first extended position where the upper housing does not bear on the seal and the shear screws are intact, and a second seal position, where the upper housing bears on the seal, deforming the seal radially outwards, and the shear screws are not intact;

(g) and wherein the mandrel pawls and the ratchet sub and ratchet ring cooperate to maintain the upper housing in the seal position as long as the collet fingers are trapped in the collet trap.

2. The packing device of claim 1 wherein the packing device is adapted to engage a retrieving pulling post and collet, wherein the retrieving collet fits within the collet locking tube and includes pawls adapted to engage the collet locking tube teeth, such that the retrieving pulling post and collet may be used to pull the collet locking tube to its second release position.

3. A method of setting a downhole anchor comprising a hollow cylindrical mandrel having a lower end and an upper end having a cone; a J-slot sub engaging the lower end of the mandrel, said sub defining a patterned slot having a running position, a pre-set position, a set position, and a retrieving position; a slip assembly comprising i. a lower housing having an upper end comprising a slip cage and a lower end comprising a bearing, concentrically disposed around the J-slot sub; ii. means for frictionally engaging the production tubing; iii. at least one pin disposed between the lower housing and the J-slot sub, which pin engages the slot defined by the J-slot sub; and iv. at least two slip arms each having an upper end and lower end, wherein the lower end is retained by the slip cage and the upper end comprises a tubing engaging slip, said slip arms moveable between a retracted position and an extended position wherein each said slip is disposed to slide over the cone when the slip assembly is actuated; wherein the mandrel and J-slot sub are moveable relative to the slip assembly between a running position where the pin is located in the running position in the slot and the slip arms are in the retracted position, a set position where the pin is located in the set position in the slot and the slips arms are in the extended position, a pre-set position intermediate the running position and the set position; and a retrieving position where the pin is located in the retrieving position in the slot and the slips arms are retracted; and wherein the anchor may move between the running, set, pre-set and retrieving positions by lifting and dropping the J-slot sub relative to the pin; using a wireline toolstring, said method comprising the steps of:

(a) running the anchor downhole in the running position, to an initial depth;

(b) lifting the toolstring to index the anchor to the pre-set position;

(c) lowering the toolstring to index the anchor to the set position;

(d) testing the ability of the anchor to support the toolstring weight;

(e) repeating steps (a) to (c) in another location either uphole or downhole from the initial depth if the anchor fails to support the toolstring weight in the initial depth; and (f) wherein steps (a) to (e) are performed in a single trip downhole.

4. The method of claim 3 wherein the downhole anchor is combined with the packing device as claimed in claim 1, wherein the additional step of setting the packing device by jarring the tool string to shear the shear screws is performed after step (e) during the same trip downhole as steps (a) to (e).

5. The method of claim 4 comprising the further steps of:

(a) landing a plunger stop and collet latch onto the top of the packing device;

(b) operating an intermittent lift plunger;

(c) pulling the plunger stop and collet latch; and (d) inserting a toolstring having a pulling pole and collet into the packing device mandrel, and pulling upwards to release the packing device and to index the anchor to the retrieving position, either in a single motion or two separate motions;

(e) retrieving the anchor and packing device to the surface.

* * * * *

UNITED STATES PATENT AND TRADEMARK OFFICE

CERTIFICATE OF CORRECTION

PATENT NO. : 7,347,273 B2
APPLICATION NO. : 11/163540
DATED : March 25, 2008
INVENTOR(S) : Grant George, Geoff Steele and Brent Kohls It is certified that error appears in the above-identified patent and that said Letters Patent is hereby corrected as shown below:

On the Title page, item [54] and column 1 line 1, change title to read:

-- BOTTOM HOLE COMPLETION SYSTEM
FOR AN INTERMITTENT PLUNGER --.

Signed and Sealed this

First Day of July, 2008

JON W. DUDAS
*Director of the United States Patent and Trademark Office*